US005570807A

United States Patent [19]

Busch

[11] Patent Number: 5,570,807

[45] Date of Patent: Nov. 5, 1996

[54] APPARATUS AND METHOD FOR HOLDING A CONTAINER IN ONE HAND

[76] Inventor: Gerald L. Busch, 5254 Lake Rd. E., Geneva, Ohio 44041

[21] Appl. No.: 519,597

[22] Filed: Aug. 25, 1995

[51] Int. Cl.[6] ..... B65D 25/28

[52] U.S. Cl. ..... 220/756; 220/755; 220/757; 220/759; 220/760

[58] Field of Search ..... 220/755, 756, 220/757, 760, 773, 752, 754, 759; 294/27.1; 224/217

[56] References Cited

U.S. PATENT DOCUMENTS

| | | | |
|---|---|---|---|
| 912,526 | 2/1909 | Barr | 224/182 |
| 1,157,475 | 10/1915 | Webster | 220/553 |
| 1,865,283 | 6/1932 | Sohnle | 220/736 |
| 3,419,196 | 12/1968 | Moore | 222/465.1 |
| 4,205,411 | 6/1980 | Cupp et al. | 15/257.06 |
| 4,759,306 | 7/1988 | McKenzie . | |
| 5,092,481 | 3/1992 | Skelton . | |
| 5,251,781 | 10/1993 | Skelton | 220/755 |
| 5,437,369 | 8/1995 | Spitere | 220/754 |

FOREIGN PATENT DOCUMENTS

| | | | |
|---|---|---|---|
| 84060 | of 0000 | Germany | 220/754 |
| 41256 | 8/1916 | Sweden | 220/754 |
| 990664 | 4/1965 | United Kingdom | 220/752 |

*Primary Examiner*—Stephen J. Castellano
*Attorney, Agent, or Firm*—Thomas A. Powers; C. C. Shroff; Anna Ganelina

[57] ABSTRACT

The invention provides a method and apparatus for holding an open container in one hand while providing unrestricted access to the container. The apparatus comprises a sleeve which is adapted to fit around a user's finger, a means for detachably fastening the apparatus to the container, and a means for connecting the fastening means to the sleeve. In use, the user's finger is inserted into the sleeve while the fastening means is connected to the container. The user then supports the container with the palm and remaining fingers of his hand while the apparatus links the user's finger to the container in such a way that the container is prevented from overbalancing.

20 Claims, 3 Drawing Sheets

APPARATUS AND METHOD FOR HOLDING A CONTAINER IN ONE HAND

TECHNICAL FIELD

The invention relates to a method and an apparatus for holding a container in one hand.

BACKGROUND ART

Paint cans or other containers having swingable wire handles may be hung from ladder rungs or other supports by means of a hook or loop which is formed as an integral part of the handle. Such an arrangement, while making it unnecessary for a person to carry the container by hand, does have the following drawbacks:

1) It is not always convenient to set up a ladder or support in close proximity to an area in which one wants to paint. (For example, the required painting may need to be done in a confined area.)

2) Many containers do not have handles, and hence cannot be readily hung from a support. Another method for supporting such cans is required.

Many attempts have been made to overcome these problems using various devices. For example, U.S. Pat. No. 5,251,781 relates to an adjustable sleeve of polypropylene web which is looped about a swingable handle of a conventional paint can. A user's thumb is then inserted into the sleeve while the fingers and the palm of the same hand are used to support the can. The user's thumb may then be used to steady the can by pulling on the handle. Alternatively, a rigid double-ended hook with one end adapted to be hooked around a swingable handle of a paint can and a second end adapted to be hooked around a user's thumb may be used in place of an adjustable loop. However, these devices have two major problems that have yet to be overcome:

1) Neither the sleeve nor the double-ended hook is readily applicable to paint cans without handles.

2) Neither the sleeve nor the double-ended hook fits snugly around the user's thumb, making it possible for the user's thumb to accidentally become disengaged from the device.

SUMMARY OF THE INVENTION

There is an unmet need for a device which will allow a painter to conveniently hold a paint can in one hand, whether or not the can has a handle. The device should engage both the hand in which the can is held and the can in such a way that it cannot easily become accidentally disengaged from either.

The invention provides a method and apparatus for holding an open paint can or other container in one hand while providing unrestricted access to the contents of the container. The container (depicted in FIG. 1) is most commonly cylindrical and comprises a bottom (1), a side (2) and a rim (3) which is an integral part of the side. The rim of the container defines the shape of an opening through which the contents of the container may be accessed. A swingable handle (4) may be fastened to the side of the container.

The apparatus of the invention comprises a sleeve, a means for detachably fastening the apparatus to the container which is to be held, and a means for connecting the fastening means to the sleeve. The sleeve is adapted to fit snugly around a user's thumb or forefinger (hereinafter referred to simply as the user's finger). In use, the user's finger is inserted into the sleeve while the fastening means is connected to either the rim or the handle of the container. The user then supports the container with the palm and remaining fingers of his hand while the apparatus described herein links the user's finger to the container rim or handle in such a way as to prevent the container from overbalancing.

DESCRIPTION OF DRAWINGS

In FIG. 5, assembly of the apparatus is incomplete; the apparatus of FIG. 6 is fully assembled.

DETAILED DESCRIPTION OF THE PREFERRED EMBODIMENTS

Figure 1:
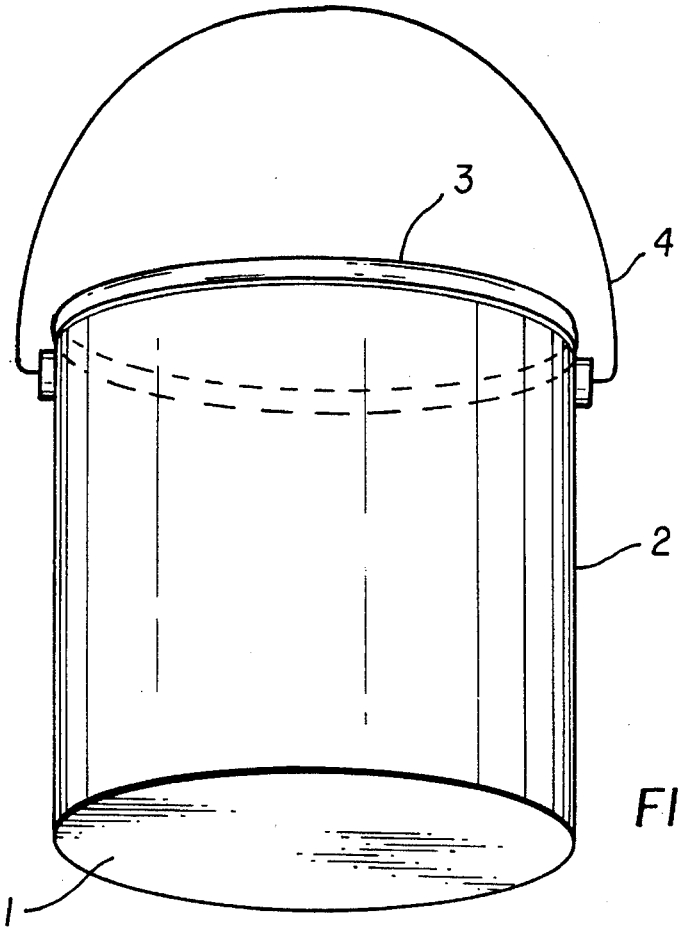
FIG. 1 is an illustration of a conventional container which may be held in one hand by using the present invention.
Figure 2:
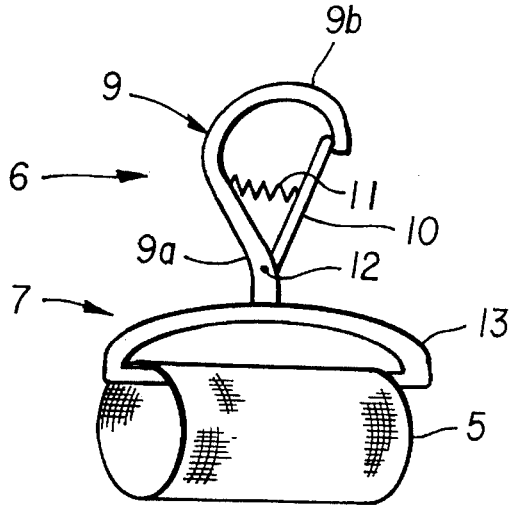
FIG. 2 is a view of the apparatus described herein, where the apparatus is designed to have a fixed length.
Figure 3:
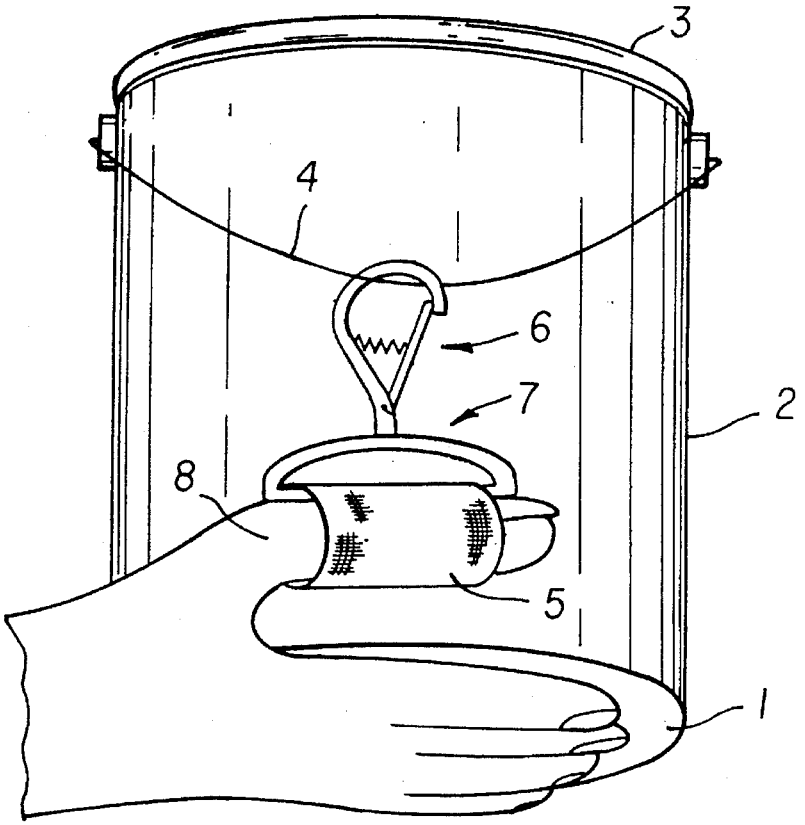
FIG. 3 shows the apparatus in use to facilitate holding a container having a handle in one hand, where the apparatus is connected to the handle.
Figure 4:
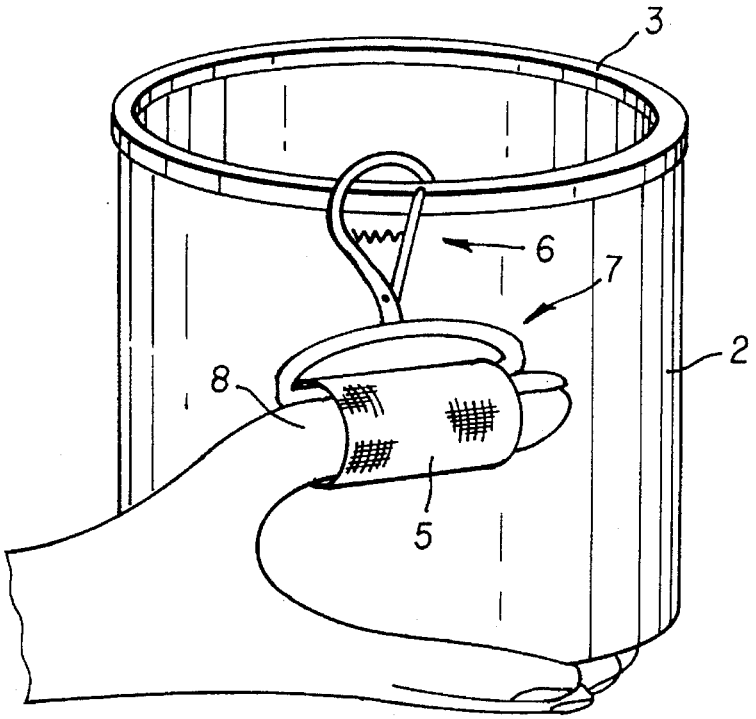
FIG. 4 shows the apparatus in use to facilitate holding a container having a rim in one hand, where the apparatus is connected to the rim of the container.

The apparatus of the invention (depicted in FIG. 2) comprises a sleeve (5), a means for detachably fastening the apparatus to the container which is to be held (6), and a means for connecting the fastening means to the sleeve (7). The sleeve is a loop of flexible, resilient material which snugly fits around a user's finger (8). In a preferred embodiment, the sleeve is made of an air- and moisture-permeable breathable web, so as to allow evaporation of moisture. The sleeve is typically formed of a strip of material, the ends of which may be fastened or bonded to form a closed loop. If desired, the ends of the strip may be irreversibly fastened by bonding the ends of the strip together with an adhesive or by sewing the ends of the strip together. Alternatively, the ends of the strip may be reversibly fastened by means of a swatch of nylon-based hook-type fasteners and a swatch of nylon-based loop-type fasteners, known under the trade name Velcro. These swatches are sewn onto opposite ends of the strip so that, when the swatches are placed in contact and fastened together, the strip forms the desired sleeve.

The means for detachably fastening the apparatus to the container is usually a spring clip. The clip preferably comprises a curved hook (9), said hook having a first end (**9*a*) which is fastened to the means for connecting means (7) and a second end (9*b*) which is adapted to fit around the rim or handle of the container; a bar (10) which is movably connected to the hook in such a way that the bar may be reversibly moved into contact with the second end of the hook; and a spring (11) which biases the bar toward the second end of the hook until they make contact. The bar is preferably connected to the first end of the hook. One of the most common ways for movably attaching the bar to the hook is by means of a hinge or pivot pin (12**). In operation, the fastening means is attached to the container by manually moving the bar away from the second end of the hook and placing the hook over the rim or handle of the container, and releasing the bar. The spring then forces the bar against the second end of the hook, closing the spring clip about the desired portion of the container.

The means for connecting the fastening means to the sleeve is usually comprises a noncircular ring made of a rigid material (13). The ring may be of any desired shape, as long as at least one portion of the ring is straight and has a length which is at least equal to the length of the sleeve. This straight portion of the ring passes through the sleeve without crimping or bending of the sleeve material. The ring and sleeve may be connected in this manner by passing the strip of material used to form the sleeve through the ring, and then fastening the ends of the strip together to form a sleeve which is interlocked with the ring. Formation of sleeves from strips having ends which may be reversibly fastened has the advantage of allowing worn-out sleeves to be removed from the connecting means and replaced. However, if desired, the sleeve interlocked with the connecting means may be made of a strip of material having ends which may be permanently fastened. The fastening means is connected to the noncircular ring at a portion of the ring other than the straight portion which engages the sleeve.

In addition to connecting the fastening means to the sleeve, the connecting means also separates the sleeve from the fastening means by a defined distance. While this distance may be fixed, it is preferred that the distance be adjustable. A connecting means of adjustable length is useful because it allows a single apparatus to be used on a variety of containers of different sizes.

Figure 5:
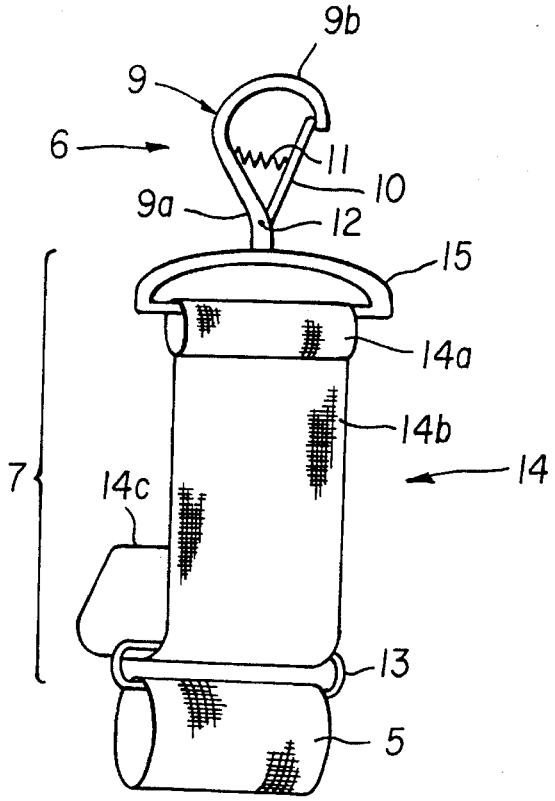
FIGS. 5 and 6 show two views of an apparatus of the present invention, where the apparatus is designed to have an adjustable length.
Figure 6:
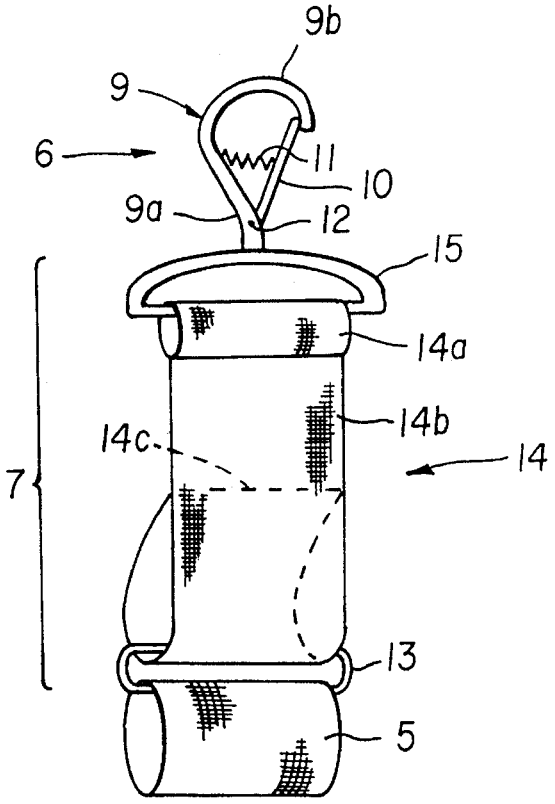

One way of doing this, illustrated in FIG. 5, is to use a connecting means which comprises a noncircular ring as previously described, and a strip of flexible material (14) having a first end (14*a*) which is connected to the fastening means by a linking means (15). The sleeve and the ring are interlocked with a portion of the ring passing through the sleeve. The strip of material has a second end (14*c*) and a middle portion (14*b*) and is connected to the noncircular ring by passing the second end of the strip through the ring and then adjustably fastening the second end to the middle portion of the strip, forming a closed loop which interlocks with the ring, as shown in FIG. 6.

The second end of the strip may be fastened to the middle portion in several ways. One way is through the use of a buckle which is permanently attached to the second end of the strip and simultaneously slidably fastened to the middle portion. The distance between the sleeve and the fastening means may then be changed by sliding the buckle from one position on the middle portion of the strip to a different position.

If desired, a rigid connecting means of adjustable length may be used. For example, a cylindrical tube may be welded to a noncircular ring. The fastening means may similarly have a post which slides into the hollow tube. A screw may be screwed through a hole in the wall of the cylindrical tube so that the end of the screw is driven against the post, fixing the position of the post relative to the tube. The screw may then be loosened, allowing the post to be moved so as to change the length of the connecting means.

Alternatively, the second end of the strip may be fastened to the middle portion through the use of a strip of nylon loop material which runs along the length of the middle portion of the strip and a swatch of nylon hook material which is fastened to the second end of the strip. The loop material and the hook material are placed into contact so that they interlock, fastening the second end to the middle portion. Preferably, the strip of loop material is longer than the swatch of hook material. This allows the user to control the distance between the fastening means and the sleeve by selecting a specific point along the strip of loop material and fastening the second end of the strip to that specific point.

When using the device, the means for fastening the apparatus to the container is attached to either the container rim or to the swingable handle of the container. If a spring clip is used as a the fastening means, the clip is attached to the rim or the handle of the container as previously described. Next, the user inserts his finger into the sleeve. The user then supports the bottom of the container with the palm and remaining fingers of the same hand, while stabilizing the container by pulling on the apparatus with the finger in the sleeve. This has the effect of pulling the container rim or handle toward the user's finger so that the container cannot fall away from said finger and out of the user's hand.

What is claimed is:

1. An apparatus for holding a container having a bottom, a side wall connected in a leak-proof manner to the bottom, a rim connected to the side wall which defines an opening in the top of the container, and optionally a swingable handle fastened to the container at opposite sides of the opening; said apparatus comprising:

a) a sleeve formed of a closed loop of material, said sleeve being adapted to fit around a user's finger;

b) a means for detachably fastening the apparatus to the rim of the container by engaging the rim between a plurality of rigid members which are biased toward each other; and c) a means for connecting the fastening means to the sleeve.

2. The apparatus of claim 1, where the sleeve is flexible and adapted to fit snugly around the user's finger.

3. The apparatus of claim 2, where the flexible sleeve is made of a moisture- and air-permeable web.

4. The apparatus of claim 2, where the sleeve is made of a strip of material having ends which are fastened together to form a closed loop.

5. The apparatus of claim 4, where the ends of the strip are permanently fastened together by means of an adhesive to form a closed loop.

6. The apparatus of claim 4, where the ends of the strip are sewn together to form a closed loop.

7. The apparatus of claim 4, where the sleeve is made of a strip of material having ends which are reversibly fastened together to form a closed loop.

8. The apparatus of claim 4, where the sleeve is made from a strip of material having a swatch of nylon-based hook fasteners fastened to one end of the strip and a swatch of nylon-based loop fasteners at the other end of the strip, further characterized in that the swatch of hook fasteners is interengaged with the swatch of loop fasteners so as to fasten the ends of the strip together to form a closed loop.

9. The apparatus of claim 2, where the connecting means comprises a noncircular ring made of a rigid material, characterized in that the ring has a straight portion having a length which is at least equal to the length of the sleeve, where the fastening means is connected to a portion of the ring other than the straight portion and where the straight portion of the ring passes through the sleeve without causing any bending or crimping of the sleeve material in such a way that the sleeve and the ring are interlocked.

10. The apparatus of claim 2, where the fastening means is a spring clip comprising:

a) a curved hook having a first end which is connected to the connecting means and a second end which is adapted to fit around the rim of the container;

b) a bar which is movably connected to the first end of the hook in such a way that the bar may be reversibly moved into contact with the second end of the hook; and c) a spring which biases the bar toward the second end of the hook until they make contact.

11. The apparatus of claim 2, where the connecting means separates the sleeve from the fastening means by a defined distance, said distance being adjustable.

12. The apparatus of claim 9, where the fastening means is connected to the ring by a strip of material having a first end which is connected to the fastening means, a middle portion, and a second end, where the second end of the strip is passed through the ring and then is folder over and adjustably fastened to the middle portion so as to form a closed loop which is interlocked with the ring.

13. The apparatus of claim 12, where the second end of the strip is attached to the middle portion by means of a buckle which is simultaneously permanently fastened to the second end and slidably fastened to the middle portion.

14. The apparatus of claim 9, where the fastening means is connected to the ring by means of a strip of material having a first end which is connected to the fastening means, a middle portion having a strip of nylon loop material on one side, and a second end having a swatch of nylon hook material on the same side of the strip of material, where the second end of the material is passed through the ring and folded over so that the strip of look material fastens to the swatch of hook material so as to form a closed loop which interlocks with the ring.

15. The apparatus of claim 14, where the strip of loop material is longer than the swatch of hook material.

16. An apparatus for holding a container having a bottom, a side wall connected in a leakproof manner to the bottom, a rim connected to the side wall which defines an opening in the top of the container, and optionally a swingable handle fastened to the container at opposite sides of the opening; said apparatus comprising:

a) a sleeve formed of a closed loop of material, said sleeve being adapted to fit around a user's finger;

b) a means for detachably fastening the apparatus to a portion of the container selected from the group consisting of the rim and the swingable handle; and c) a means for connecting the fastening means to the sleeve; where the fastening means is a spring clip.

17. The apparatus of claim 16, where the connecting means comprises a noncircular ring made of a rigid material, characterized in that the ring has a straight portion having a length which is at least equal to the length of the sleeve, where the fastening means is connected to a portion of the ring other than the straight portion and where the straight portion of the ring passes through the sleeve in such a way that the sleeve and the ring are interlocked.

18. The apparatus of claim 16, where the fastening means is a spring clip comprising:

a) a curved hook having a first end which is connected to the connecting means and a second end which is adapted to fit around the portion of the container;

b) a bar which is movably connected to the first end of the hook in such a way that the bar may be reversibly moved into contact with the second end of the hook; and c) a spring which biases the bar toward the second end of the hook until they make contact.

19. The apparatus of claim 16, where the connecting means separates the sleeve from the fastening means by a defined distance, said distance being adjustable.

20. The apparatus of claim 17, where the fastening means is connected to the ring by a strip of material having a first end which is connected to the fastening means, a middle portion, and a second end, where the second end of the strip is passed through the ring and then is folded over and adjustably fastened to the middle portion so as to form a closed loop which is interlocked with the ring.

* * * * *